US010011136B2

(12) United States Patent
Broeckert et al.

(10) Patent No.: US 10,011,136 B2
(45) Date of Patent: Jul. 3, 2018

(54) INK CURING APPARATUS AND METHOD

(71) Applicant: Brown Manufacturing Group, Inc., Wyoming, MI (US)

(72) Inventors: Hans P. Broeckert, Grand Rapids, MI (US); Stephen M. Harpold, Grand Rapids, MI (US)

(73) Assignee: Brown Manufacturing Group, Inc., Wyoming, MI (US)

( * ) Notice: Subject to any disclaimer, the term of this patent is extended or adjusted under 35 U.S.C. 154(b) by 5 days.

(21) Appl. No.: 15/117,290

(22) PCT Filed: Feb. 11, 2015

(86) PCT No.: PCT/US2015/015321
§ 371 (c)(1),
(2) Date: Aug. 8, 2016

(87) PCT Pub. No.: WO2015/123242
PCT Pub. Date: Aug. 20, 2015

(65) Prior Publication Data

US 2017/0021655 A1 Jan. 26, 2017

Related U.S. Application Data

(60) Provisional application No. 61/939,515, filed on Feb. 13, 2014.

(51) Int. Cl.
*B41J 11/02* (2006.01)
*B41M 7/00* (2006.01)
(Continued)

(52) U.S. Cl.
CPC ..... *B41M 7/009* (2013.01); *B41J 11/002* (2013.01); *D06P 5/2077* (2013.01); *B41J 3/4078* (2013.01)

(58) Field of Classification Search
CPC .. B41M 7/0081; B41M 7/009; B41M 7/0072; B41J 11/002; B41J 3/4078; D06P 5/2077
See application file for complete search history.

(56) References Cited

U.S. PATENT DOCUMENTS 5,276,978 A 1/1994 Hopkins et al.
5,711,603 A 1/1998 Ringermacher et al.
(Continued)

FOREIGN PATENT DOCUMENTS

CN 203038893 U 7/2013
JP 2003237034 A 8/2003
(Continued)

OTHER PUBLICATIONS

International Preliminary Report on Patentability from corresponding Patent Cooperation Treaty (PCT) Patent Application No. PCT/US2015/015321, dated Aug. 25, 2016.
(Continued)

*Primary Examiner* — David Banh
(74) *Attorney, Agent, or Firm* — Gardner, Linn, Burkhart & Ondersma, LLP

(57) ABSTRACT

An ink curing apparatus for curing ink on an object and method includes at least one thermal imaging sensor that is configured to image thermal radiation of the object and at least one heating element that is configured to generate heat energy. A control responsive to the imaging sensor controls the heating element. The control controls the heating element as a function of the thermal radiation of the object to heat the object to a particular radiation level. The method may be used to cure ink on the object. The object may be made of a textile. The method may be used with at least one chosen from screen printing, digital printing, sublimation ink printing, discharge ink printing, and pad printing.

29 Claims, 17 Drawing Sheets

(51) Int. Cl.

| | |
|---|---|
| ***B41J 11/00*** | (2006.01) |
| ***D06P 5/20*** | (2006.01) |
| *B41J 3/407* | (2006.01) |

(56) References Cited

U.S. PATENT DOCUMENTS

| | | | | |
|---|---|---|---|---|
| 5,908,000 | A | 6/1999 | Spychalla et al. | |
| 5,937,535 | A | 8/1999 | Hoffman, Jr. et al. | |
| 6,013,915 | A | 1/2000 | Watkins | |
| 6,161,304 | A | 12/2000 | Iaccino et al. | |
| 6,401,358 | B1 | 6/2002 | Bar et al. | |
| 6,690,016 | B1 | 2/2004 | Watkins et al. | |
| 6,877,247 | B1 | 4/2005 | DeMoore | |
| 7,347,008 | B2 | 3/2008 | Zupancic et al. | |
| 2003/0123518 | A1 | 7/2003 | Abbasi et al. | |
| 2003/0161552 | A1* | 8/2003 | Shima | B41J 11/002 382/312 |
| 2006/0128243 | A1* | 6/2006 | Kong | A41D 31/00 442/182 |
| 2006/0143940 | A1 | 7/2006 | Yidi, Jr. et al. | |
| 2008/0079795 | A1* | 4/2008 | Nakazawa | B41J 11/002 347/102 |
| 2010/0066791 | A1* | 3/2010 | Jeremic | B41J 11/002 347/102 |
| 2010/0085406 | A1* | 4/2010 | Kimura | B41F 23/0409 347/102 |
| 2010/0220141 | A1* | 9/2010 | Ozawa | B41J 3/28 347/18 |
| 2011/0131829 | A1 | 6/2011 | Zagar et al. | |
| 2011/0290777 | A1 | 12/2011 | Pedemonte et al. | |
| 2012/0154498 | A1 | 6/2012 | Chiwata | |
| 2014/0245950 | A1* | 9/2014 | Seccombe | B41J 3/60 118/620 |
| 2016/0167399 | A1* | 6/2016 | Ohnishi | B41J 2/01 347/102 |

FOREIGN PATENT DOCUMENTS

| | | | |
|---|---|---|---|
| JP | 2003237036 | A | 8/2003 |
| WO | 9940417 | A1 | 8/1999 |
| WO | 2010132634 | A1 | 11/2010 |

OTHER PUBLICATIONS

International Search Report and Written Opinion of the International Searching Authority from corresponding Patent Cooperation Treaty (PCT) Patent Application No. PCT/US15/15321, dated Jun. 8, 2015.

* cited by examiner

INK CURING APPARATUS AND METHOD

CROSS REFERENCE TO RELATED APPLICATION

This application claims the priority benefits of International Patent Application No. PCT/US2015/015321, filed on Feb. 11, 2015, which claims priority from U.S. patent application Ser. No. 61/939,515, filed on Feb. 13, 2014, the disclosures of which are hereby incorporated herein by reference in their entirety.

BACKGROUND OF THE INVENTION

The present invention is directed to a temperature curing apparatus and method. While the invention is described with respect to curing ink on a fabric, it is capable of other applications including other types of ink printing, food preparation, plastic forming, and the like.

Many inks require a certain amount of heat in order to cure. In most print shops, products are produced on a continuous basis at ever-increasing speeds. Traditional curing methods have employed heat presses, drawer dryers, and tunnel dryers. However, as the printing machinery capacity has increased, the associated capacity of the curing technology has remained stagnant.

Tunnel dryers, which exist mainly as gas dryers and infrared dryers, either have a series of radiant infrared panels arranged above a continuous belt or one or more gas burners heating air, which is then blown through the belt. Product is placed on a belt at the front of the dryer, and moves at a constant speed through the length of the tunnel. The product is then removed from the back of the dryer, or simply drops off the belt into a catch container. The continuous nature of the dryer dramatically reduces the labor associated with placing items on the curing unit, and then removing them after they are cured, and are inherently scalable, since they can be made arbitrarily long to accommodate arbitrarily fast printing speeds. However, infrared dryers have a major disadvantage in that the final temperature of the product depends on the temperature of elements and the belt speed (the amount of time the product is under the elements). A delicate balance exists between belt speed and element temperature as product continues to absorb energy as long as it is under the elements, and so it never reaches an equilibrium temperature. If the product is in the chamber for too short a time, it never reaches cure temperature. Conversely, if the product is in the chamber for too long a time, it will overshoot its cure temperature and may scorch or dull the ink. Since many factors affect the time required to reach cure temperature (initial product temperature, initial humidity of product, amount of ink deposit on the product, initial temperature of the tunnel, etc.), the product defect rate from an IR dryer is often higher than desired. Gas dryers have a major disadvantage in that the rate of heat transfer from the air to the product decreases as the product approaches the temperature of the air. Thus, gas dryers are inherently slower than similarly-sized infrared dryers. While there are several different technologies currently on the market to cure inks, they all have very significant drawbacks.

SUMMARY OF THE INVENTION

New advancements in screen printing, number printing, digital printing, and the like, highlight drawbacks of known curing technologies. Known IR dryers cannot maintain the cure temperature for the amount of time required by the new inks, and gas dryers must be too large to handle the higher volume of product produced by the new generation of industrial digital printers. The present invention fulfills the need for a new curing apparatus and method. It also provides benefits that are applicable to other applications where precision is desirable.

An ink curing apparatus for curing ink on an object and method, according to an aspect of the invention, includes at least one thermal imaging sensor that is configured to image thermal radiation of the object and at least one heating element that is configured to generate heat energy at the object. A control responsive to the imaging sensor controls the heating element. The control controls the heating element as a function of the thermal radiation of the object to heat the object to a particular radiation level. The method may be used to cure ink on the object. The object may be made of a textile. The method may be used with at least one chosen from screen printing, digital printing, sublimation ink printing, discharge ink printing, and pad printing.

The at least one heating element may be between the imaging sensor and the object and the heating apparatus or method including at least one shield between the at least one thermal imaging sensor and said at least one heating element. The shield shields the at least one heating element from the at least one thermal imaging sensor. The at least one heating element may be a plurality of heating elements. The at least one shield may be a plurality of shields, one for each of the heating elements. The plurality of shields may be joined together to form a shield assembly. A position adjustment for the shield assembly adjusts positions of the shields so the shields can be adjusted together.

The heating elements may be quartz heating elements. The heating elements may have a color temperature in a range from about 1700K to about 1900K. The control may control the heating elements as a function of surface radiation of the object adjacent each particular heating element or adjacent heating elements. The control may combine a selected number of adjacent heating elements to at least partially control together. The number of adjacent heating elements that can be at least partially controlled together can be selected according to the object to be heated. The number of adjacent heating elements to be partially controlled together is selected from one, two or three adjacent heating elements.

A conveying surface may be provided to convey articles past a controlled area controlled by the control from an upstream location toward a downstream location. The control area may include the plurality of heating elements. The heating elements at the upstream location may have a higher wattage than heating elements at the downstream location. An entrance sensor senses an object on the conveying surface entering the controlled area. The entrance sensor may be a photo sensor including a light beam directed across an entrance to the controlled area. The control may energize the heating elements only when an object is present.

The at least one thermal imaging sensor may be an infrared sensor. The at least one thermal imaging sensor may be a pixilated camera having rows and columns of pixels of infrared sensors. The control masks artifact pixels that detect radiation from permanent objects. The thermal imaging sensor captures thermal images within a controlled area and may include reflective surfaces around the controlled area to reflect thermal energy at edges of the controlled area back to the controlled area.

A first cooling system may be provided for removing heat energy from the at least one thermal imaging sensor and said at least one shield. A second air flowing system may be provided that is adapted to flowing air past the object being heated. The first and second systems may be substantially separate from each other. The second air flowing system may have variable air flow. The second air flowing system may have a recirculating flow pattern.

A method of curing ink applied to a fabric, according to an aspect of the invention, includes applying radiant heat to the article while monitoring thermal radiation. Radiant heat is applied at a rate sufficient to raise the temperature of the ink at a rate faster than the temperature of the fabric. Radiant heat is reduced when the temperature of the ink reaches the cure temperature and before the temperature of the fabric reaches the dye migration temperature in order to reduce bleeding of garment dye to the ink.

The ink has an ink cure temperature and the fabric has a dye migration temperature. The ink cure temperature may be equal to or above the dye migration temperature. The fabric may be a polyester or a nylon or a combination of both. The thermal image data may be captured with at least one thermal-imaging sensor directed at the object and the radiant heat applied as a function of the thermal radiation detected by the imaging sensor.

These and other objects, advantages and features of this invention will become apparent upon review of the following specification in conjunction with the drawings.

DESCRIPTION OF THE PREFERRED EMBODIMENT

Figure 1:
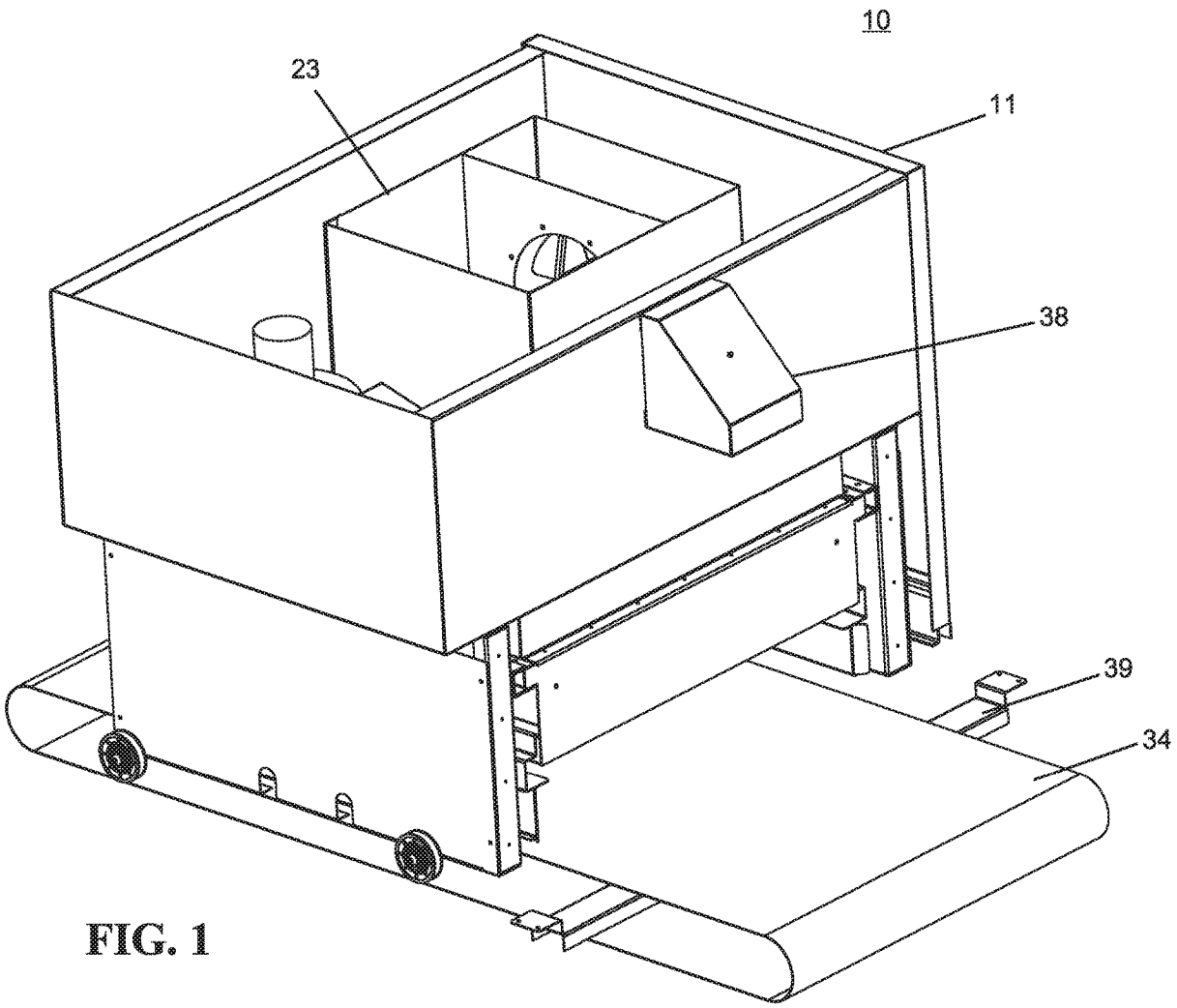
FIG. 1 is a perspective view of a heating apparatus and method, according to an embodiment of the invention.

Referring now to the drawings and the illustrative embodiments depicted therein, a heating apparatus 10 is for heating an object according to a given temperature profile and includes a housing 11 housing one or more thermal imaging sensors 12 that are configured to image thermal radiation of an object, such as a textile object that is digitally printed with ink or with ink otherwise applied. Apparatus 10 further includes one or more heating elements 14 between the imaging sensors 12 and the object, each heating element 14 configured to generate heat energy. In the illustrated embodiment, heating elements 14 are infrared lamps, such as quartz heating elements that have a color temperature in a range from about 1700K to about 1900K. As will be described in more detail below, heating elements 14 are controlled as a function of surface radiation of the object subjacent each particular heating element or combination of adjacent heating elements. A selected number of adjacent heating elements can be at least partially controlled together. For example a number of adjacent heating elements may be turned off together as a function of a rate and particular level of radiation level selected for the object to be heated. The number of adjacent heating elements to be controlled together is selected from one, two or three adjacent heating elements. In the illustrated embodiment, heating elements 14 are elongated members that are as thin as possible and spaced apart as far as possible. The elements are ⅜ inch in diameter, spaced 4.5 inches apart and located 4.5 inches over the object.

A control 18 is responsive to imaging sensors 12 for controlling heating elements 14 to heat an object in a controlled area 36 to a given radiation level such as a given temperature. Imaging sensor 12 directly images a surface temperature of the object as a function of thermal radiation given off by the object and control 18 controls heating elements 14 to heat the object to the given temperature. The object can be heated according to a heating profile of the particular type of fabric and ink applied to the fabric so that the ink can be cured but not over-cured. The heating profile may call for maintaining a particular temperature by apparatus 10 for a controlled set amount of time, for example. A conveying surface 34, such as belts, chains, grates, platens, rollers, or the like, is provided to convey objects past controlled area 36 under the control of control 18. An entrance sensor 38 senses an object on conveying surface 34 entering said controlled area 36. Entrance sensor 38 may be a light curtain or a light beam looking across an entrance to controlled area 36 and reflected back to the sensor by a reflector 39 below conveying surface 34. In this manner, entrance sensor 38 obtains a reflected beam unless an object is detected entering controlled zone 36.

Figure 2:
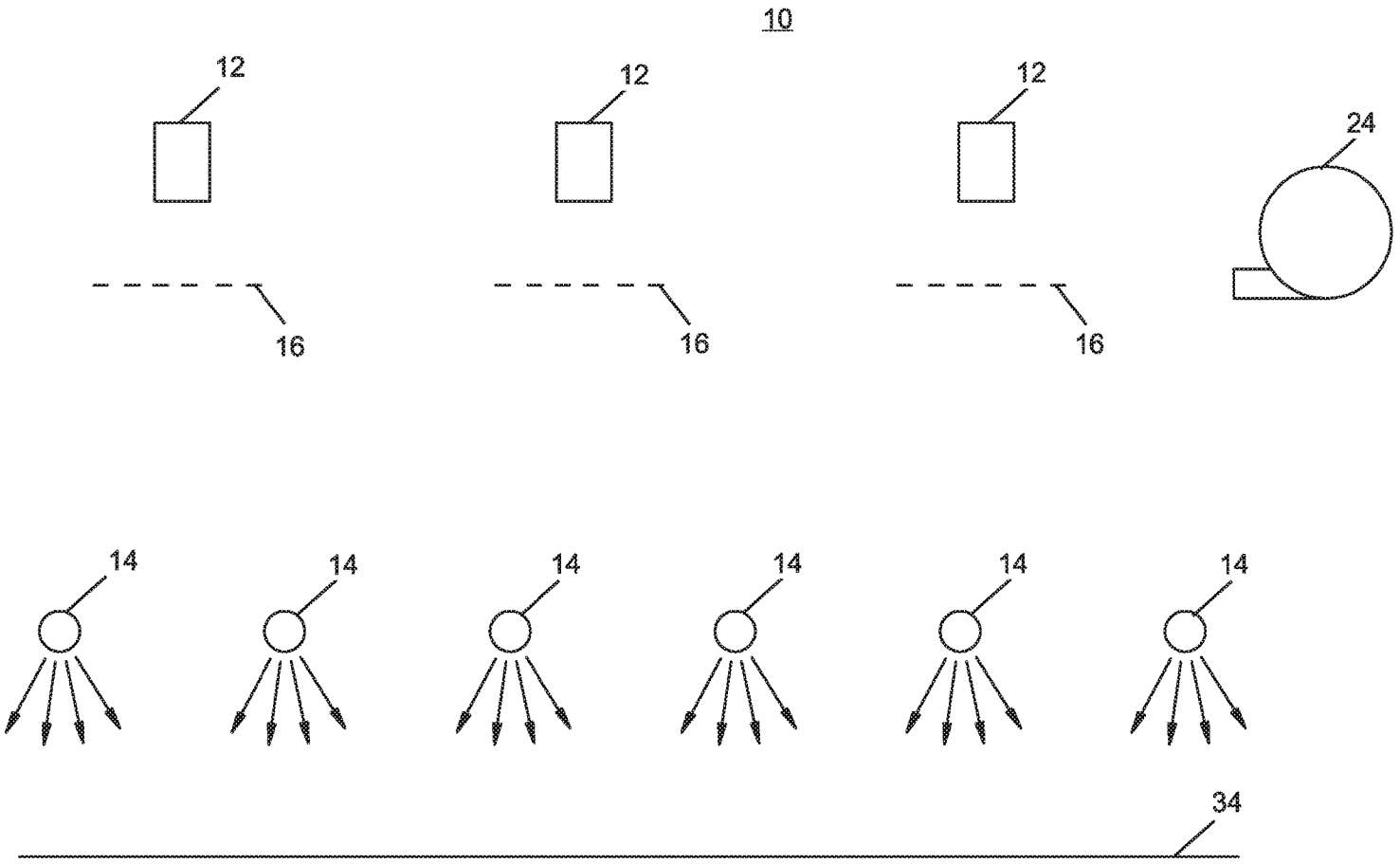
FIG. 2 is a side elevation of a heating apparatus and method in schematic form.
Figure 3A:
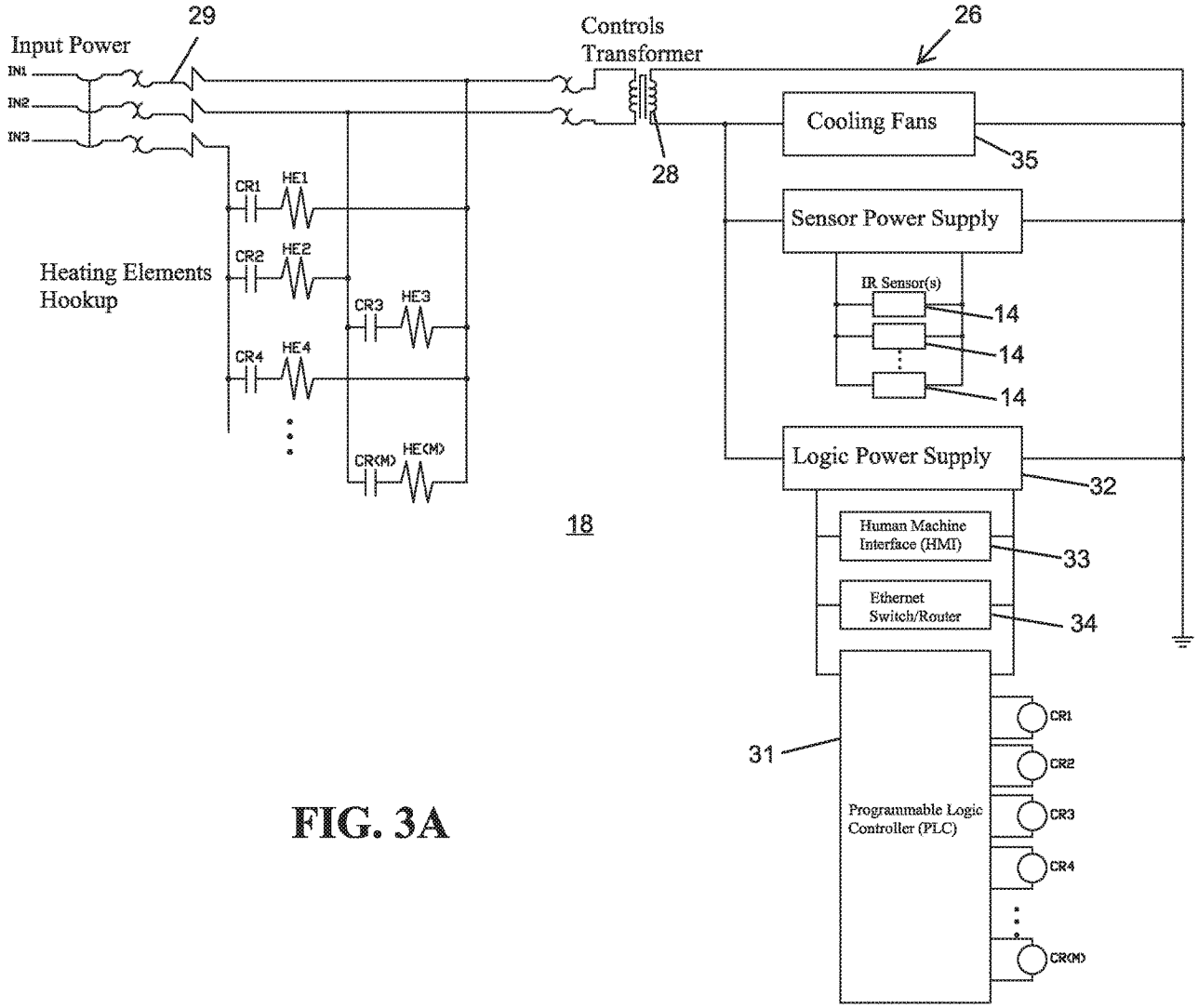
FIG. 3A is a block diagram of an electrical system.
Figure 3B:
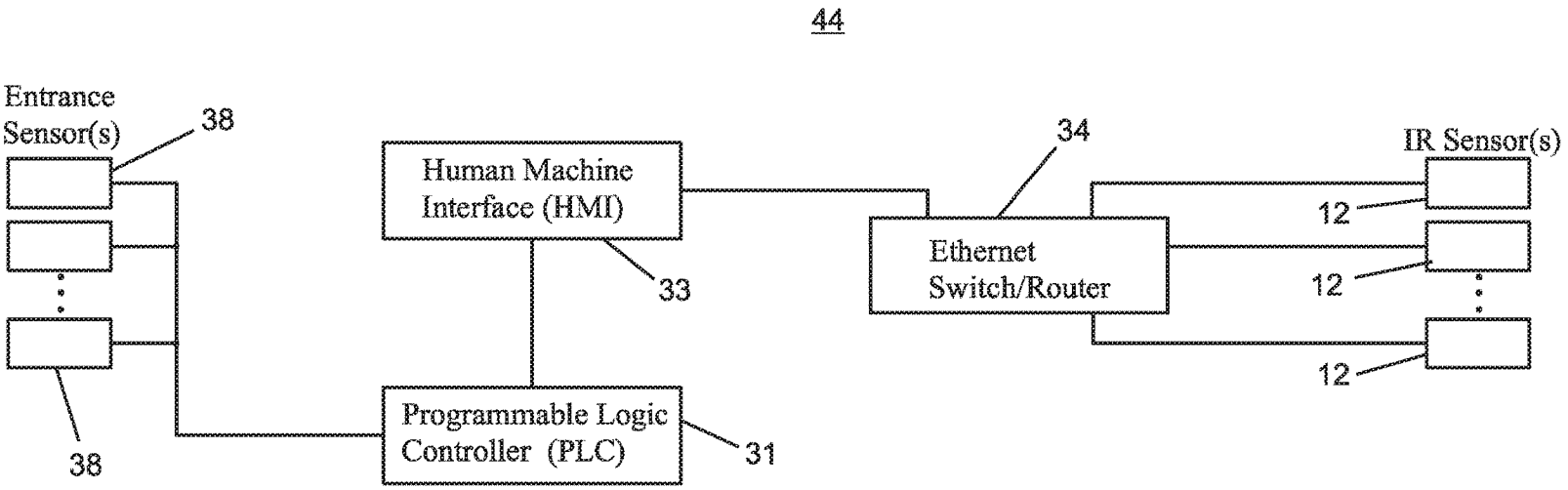
FIG. 3B is a block diagram of a communications system.

Thermal imaging sensor 12 has a defined field of view of controlled area 36 and the imaging sensor directed toward the object in the control zone as shown in FIG. 2. Thermal imaging sensor 12 in the illustrated embodiment is an infrared sensor in the form of a pixilated camera having rows and columns of pixels of infrared sensors. Sensor 12 may produce a video output signal, such as produced by security cameras, and be adapted to be connected to a viewing device, such as a video display, in which case the output would need to be processed to temperature data points. In the illustrated embodiment, thermal imaging sensor 12 reports temperature directly in a grid format for each thermal image captured. This avoids the need for post-capture signal processing to a grid.

Figure 10:
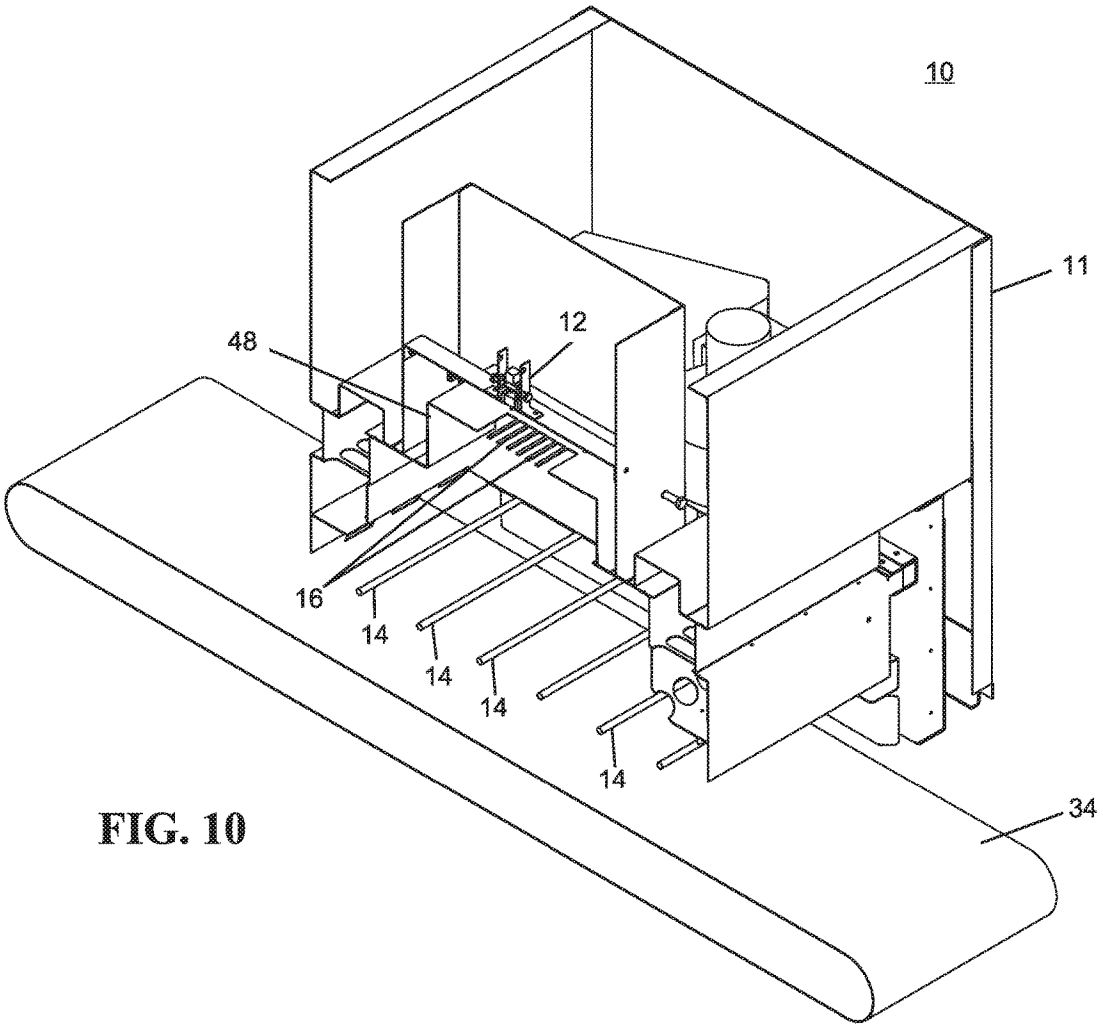
FIG. 10 is a cutaway perspective view of the heating apparatus in FIG. 1 with a portion of the apparatus removed to reveal internal features thereof.
Figure 11:
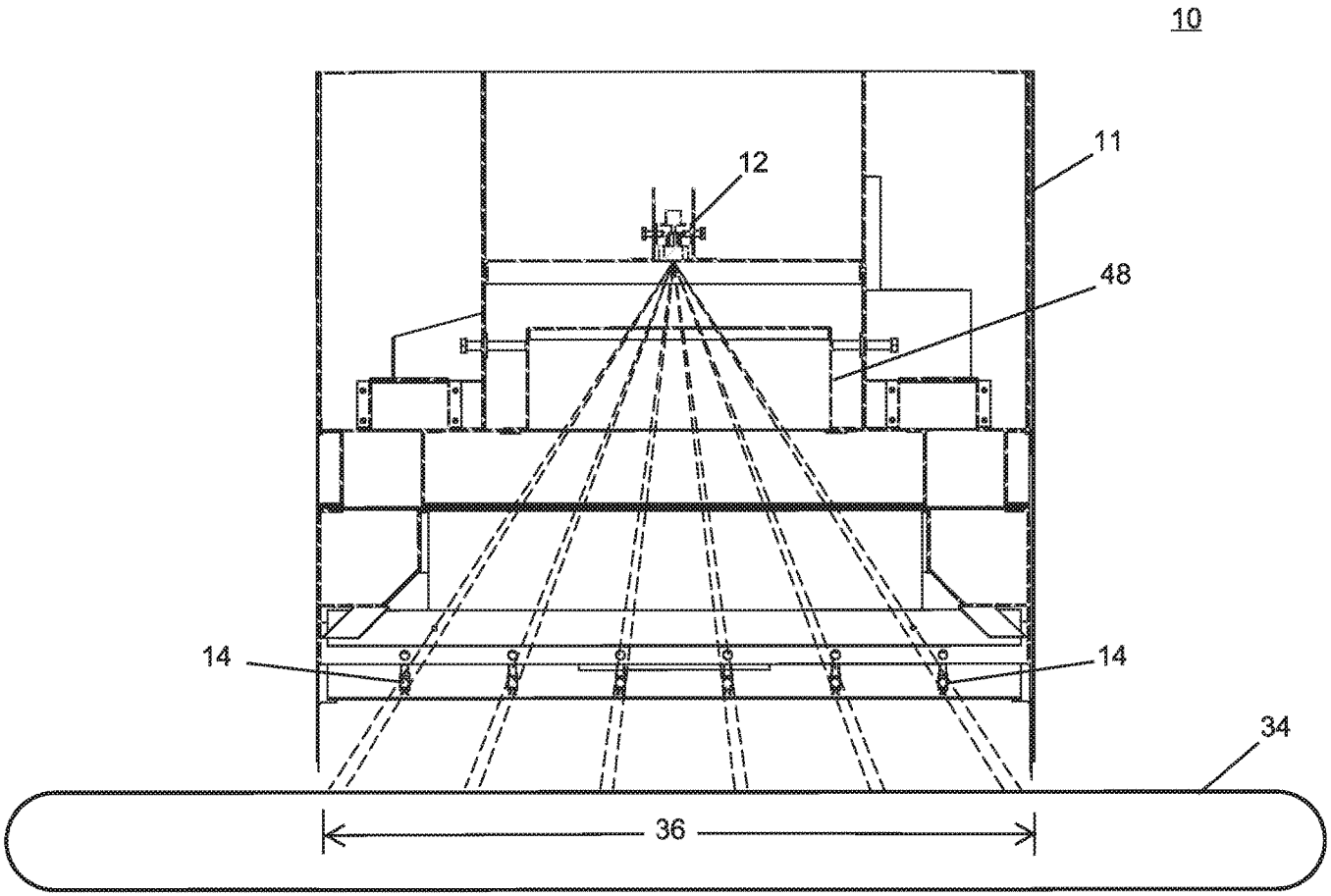
FIG. 11 is a side elevation view of the apparatus in FIG. 10 illustrating arrangement of components thereof.
Figure 12:
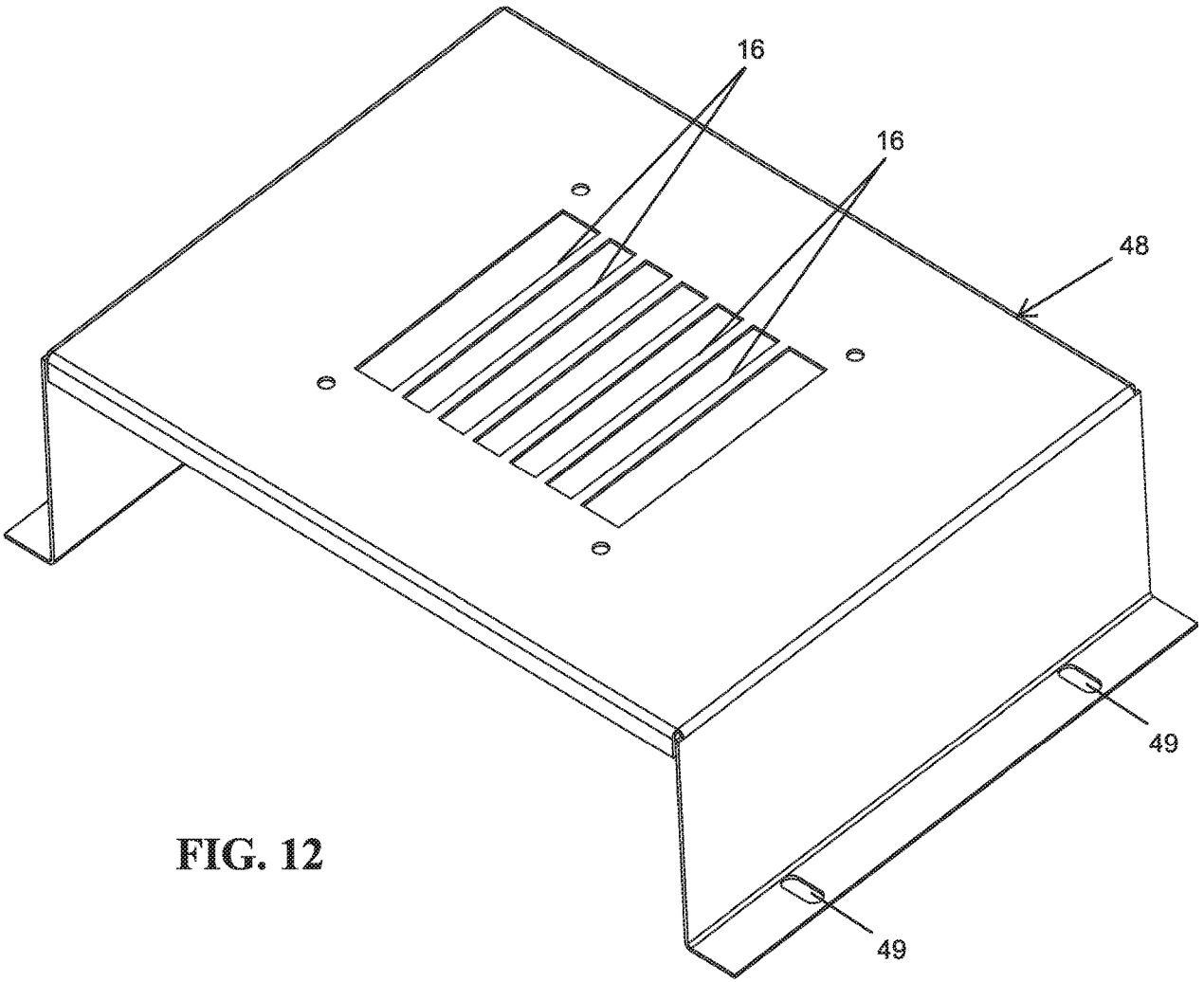
FIG. 12 is a perspective view of a shield assembly.

A shield 16 is provided between each heating element 14 and imaging sensor 12 as further illustrated in FIGS. 10 and 11. Each shield 16 blocks radiation from the subjacent heating element 14 from affecting temperatures sensed by imaging sensor 12. Thus, control 18 can function based on information from the surface of the product without being affected by intense radiation of the heating elements. Shields 16 can be joined together to form a shield assembly 48 (FIG. 12). Shield assembly 48 forms the shields 16 from a common sheet stock with adjustment slots 49. Adjustment slots 49 allows the shields to be calibrated together with one adjustment to the overall shield assembly. Otherwise, the shields can each be individually mounted and calibrated. To accommodate calibration, control 18 has a manual mode wherein heating elements 14 can be manually controlled while observing the output of imaging sensor 12 in order to precisely position shields 16 during initial installation.

Figure 16:
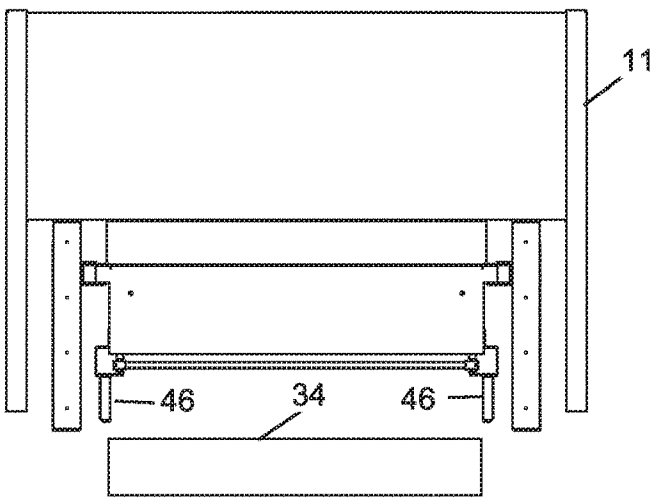
FIG. 16 is an end elevation illustrating side elevation of the control zone.
Figure 15:
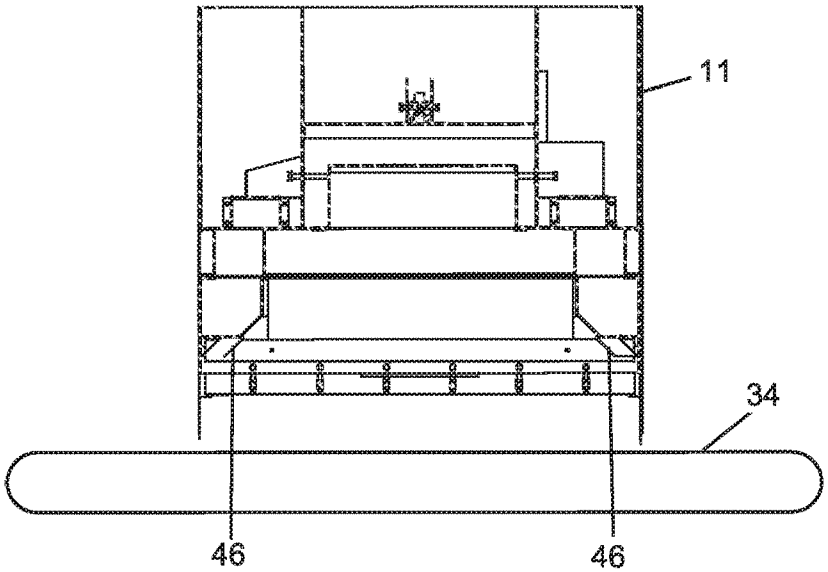
FIG. 15 is a cutaway side elevation illustrating front and rear reflectors at boundaries of the control zone.

Other hardware and software techniques may be utilized to further remove artifacts, not created by thermal radiation of the object from being captured and processed by control 18. Such artifacts are from extraneous surfaces radiating heat in housing 11. This may include removing as many reflective surfaces as possible from the controlled area and painting surfaces flat black that cannot be removed. Also, the control can be programmed to mask artifact pixels that detect radiation from permanent objects as will be set forth in more detail below. Reflective surfaces 46 (FIGS. 15 and 16) may be provided around the controlled area to reflect thermal energy at edges of the controlled area back to controlled area. Reflective surfaces 46 are for the purpose of minimizing boundary effects caused by radiation from the heating elements bleeding from the controlled area.

Figure 13:
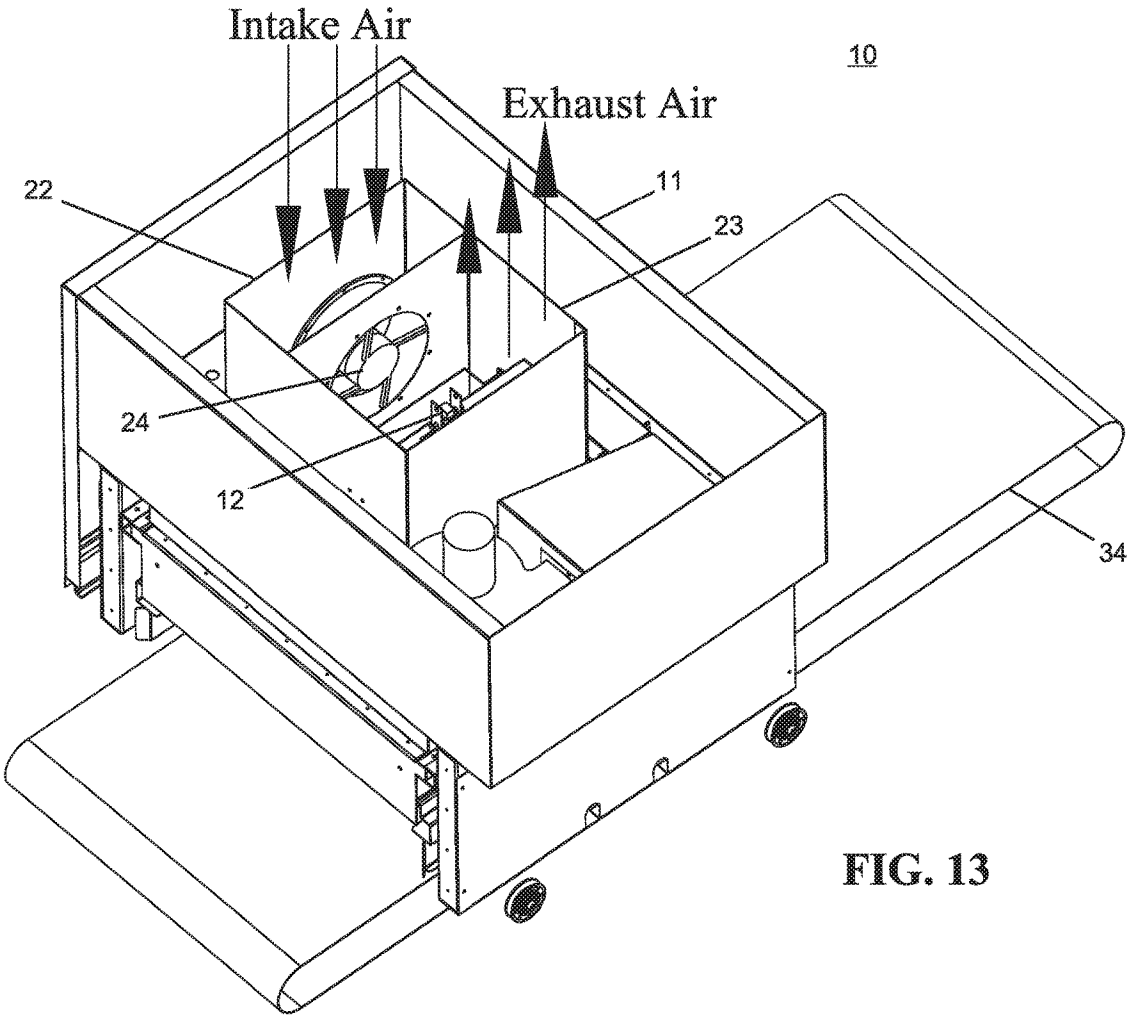
FIG. 13 is a perspective view of a first air cooling system.

A first cooling system 22, illustrated in FIG. 13, is provided for removing heat energy from imaging sensor 12 and shields 16. Cooling system 12 includes a containment housing 23 and a circulating fan 24 that draws in fresh air and forces the air over imaging sensor 12 and shields 16 (not shown in FIG. 13) and then expels the air from the housing. Housing 11 defines an individual heating zone which may be one of a plurality of tandem zones which successively heat an article travelling on conveying surface 34 in sequence from one zone to the next. In the illustrated embodiment, each zone includes an independent cooling system 22 so that the heat extracted from the camera and shields of one heating zone is not passed on to the next heating zone.

Figure 14:
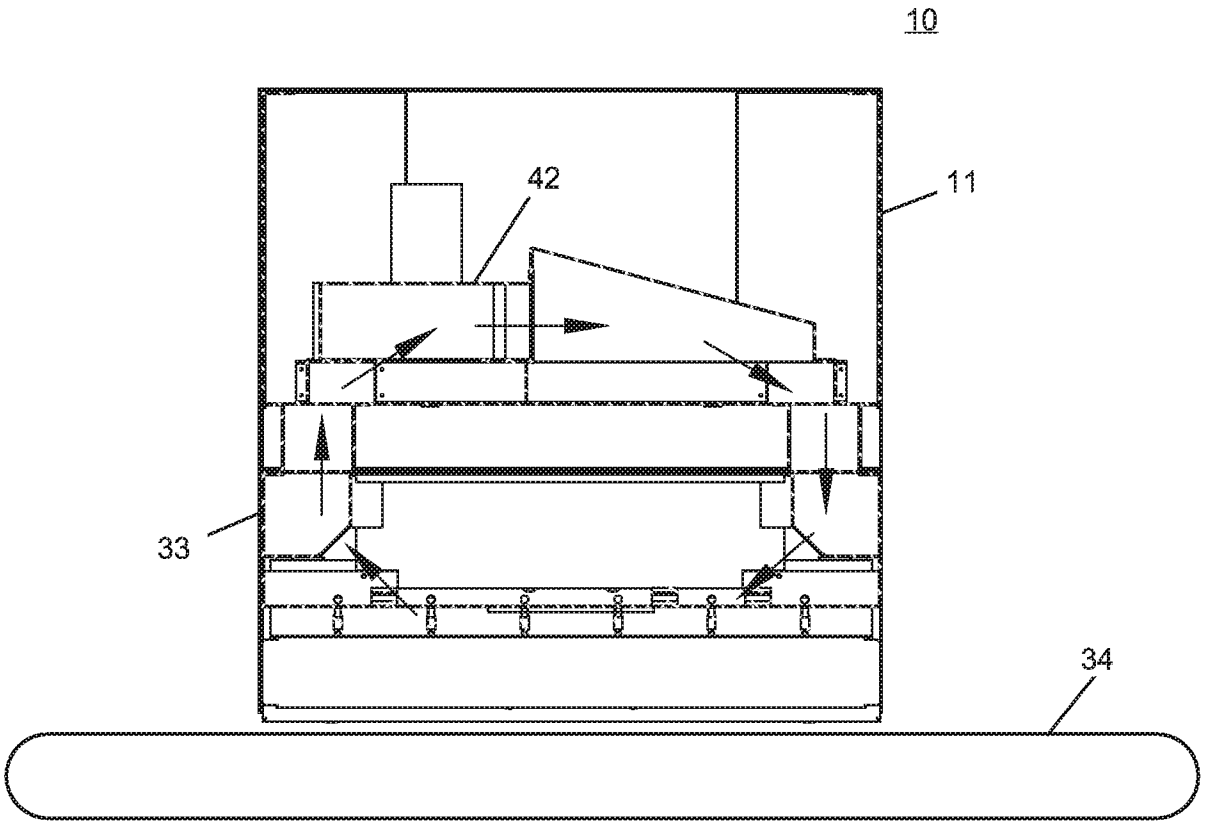
FIG. 14 is a cutaway side elevation of a second air cooling system.

A second air flow system 40, illustrated in FIG. 14, provides airflow at the level of conveying surface 34. Second air flow system 40 is variable in flow in order to provide an amount of airflow most ideal for the particular object being heated. For example, digital (printer printed) inks require more flow to remove moisture from the ink. Other objects, such as polyester fabrics, require no air flow. Because air flow system 40 is object dependent and operational at various, or no, air flow rates, it is separate from cooling system 22 which must operate according to the cooling needs of imaging sensor 22 and shields 16. Air flow system 40 is a recirculating airflow pattern 41 driven by a recirculation air fan 42 that only requires makeup air to be supplied through an intake 33. The recirculating nature reduces the amount of energy required to heat the object by heating elements 14 than if only fresh air intake were used in air flow system 40. Because flow produced by second air flow system 40 is dependent on the object being processed, fan 42 is under direct control of control 18.

Control 18 includes an electrical circuit 26 for heating apparatus 10 includes a transform 28 that receives electrical power from a three-phase power source 29 and supplies a system 35 that provides power to operate the cooling fans of cooling systems 22 and 40. Control 18 is made up of a logic controller 31, which is a programmable logic controller in the illustrated embodiment but could, alternatively, be a microcomputer, personal computer, or the like. Outputs CR(1) through CR(m) of controller 31 are supplied to heating elements 14, shown as HE1, HE2, . . . HE(M), in order to selectively turn the heating elements off or on as determined by controller 31. A power supply 32 supplies power to a human machine interface 33, an Ethernet router 34, as well as controller 31.

A communication system 44, which is Ethernet based, including Ethernet switch/router 34, routes communications between imaging sensors 12 and human machine interface 33. Programmable Logic Controller 31, in turn, provides inputs along with entrance sensor(s) 38 to human machine interface 33. By being Ethernet based, communication system 44 is able to rapidly provide frames of data captured by imaging sensors 12 to controller 31 for processing. Such inputs are integrated with other inputs, such as from the entrance sensors and the human machine interface.

Logic controller 31 of control 18 may be programmed to energize a heating element 14 only when an object is present in controlled area 36. Control 18 may use a speed of conveying surface 34 and an amount of time that entrance sensor 38 senses the presence of an object to calculate dimensions and location of the object in controlled area 36. Alternatively, control 18 may use pulse count information from the conveyor system, along with the inputs from entrance sensor 38 to calculate dimensions and location of the object in the controlled area. Control 18 may selectively activate one or more heating elements 14 that have a subjacent object below that element(s) and not activate one or more heating elements 14 that do not have a subjacent object below that element.

Figure 4:
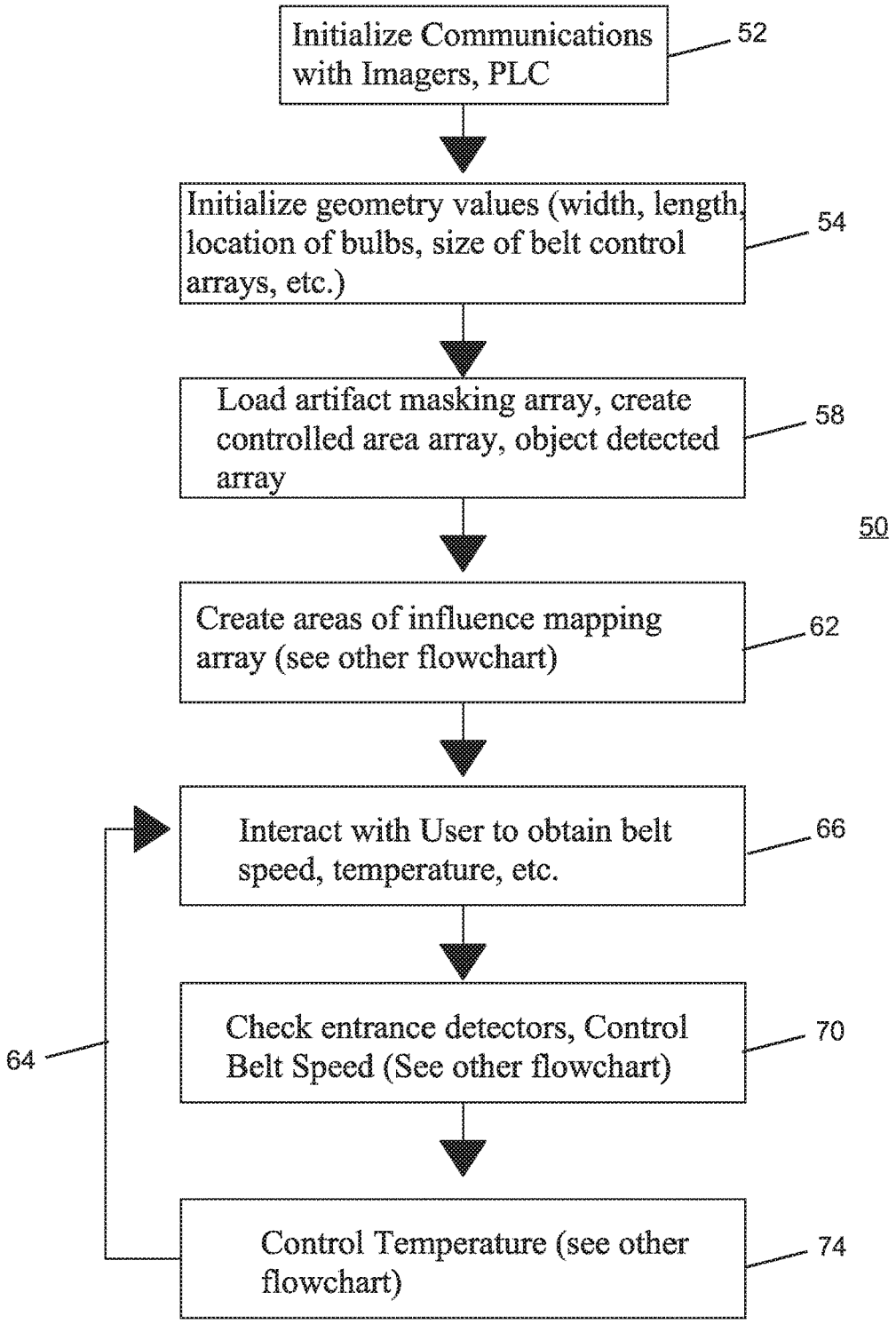
FIG. 4 is a flowchart of an overall control process.
Figure 5:
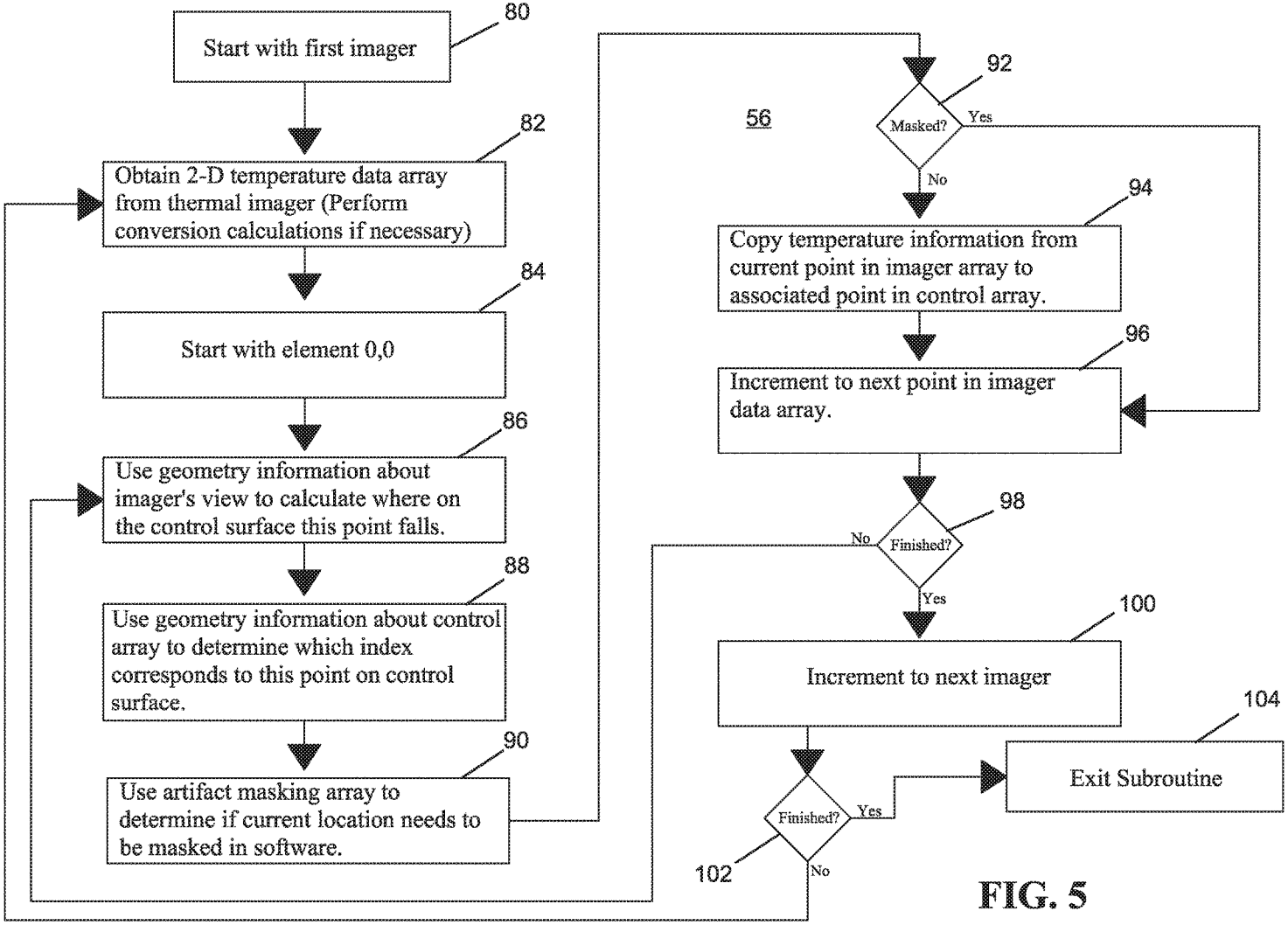
FIG. 5 is a flowchart of a mapping process to map imager information to a control array.
Figure 6:
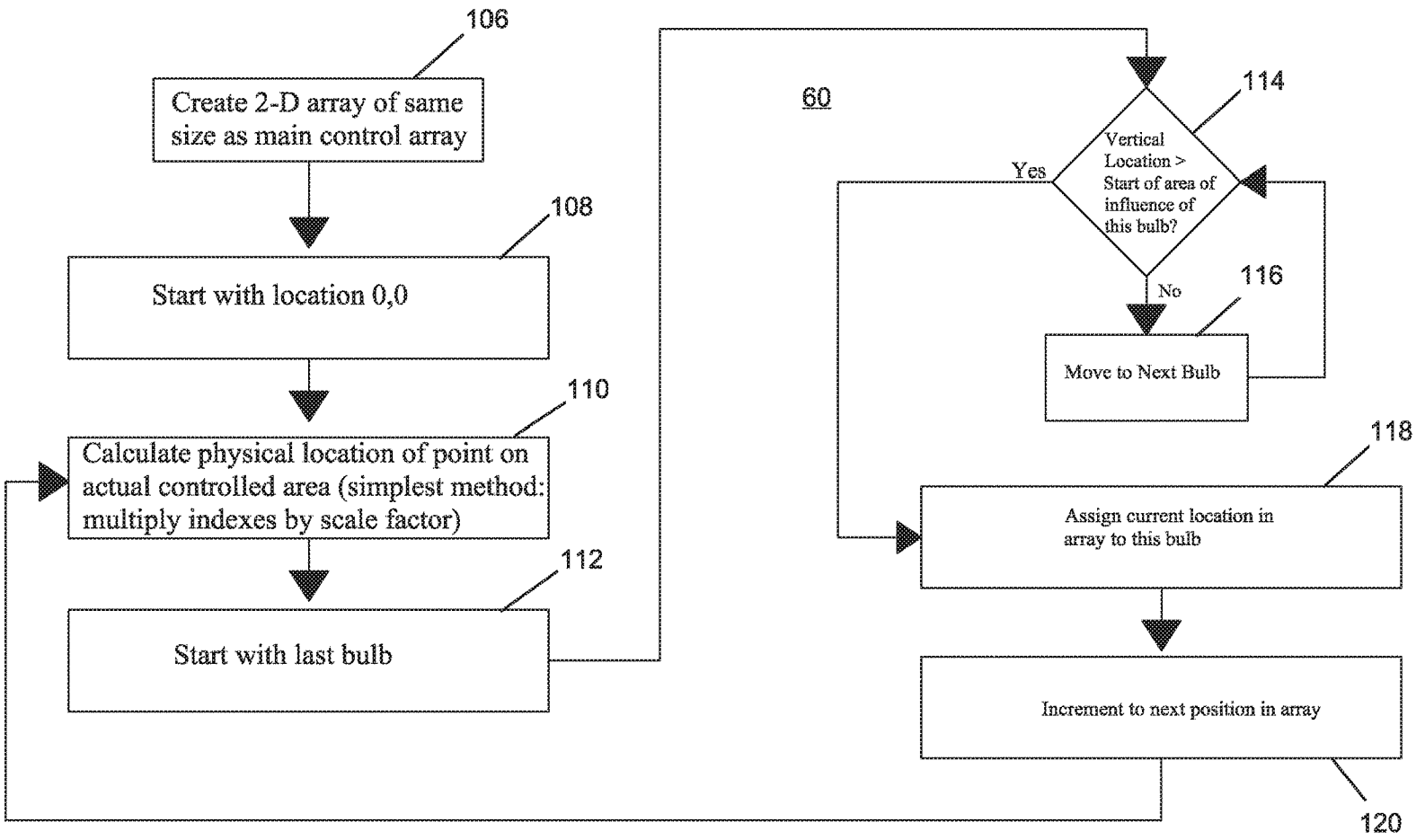
FIG. 6 is a flowchart of creating a mapping array process.
Figure 8:
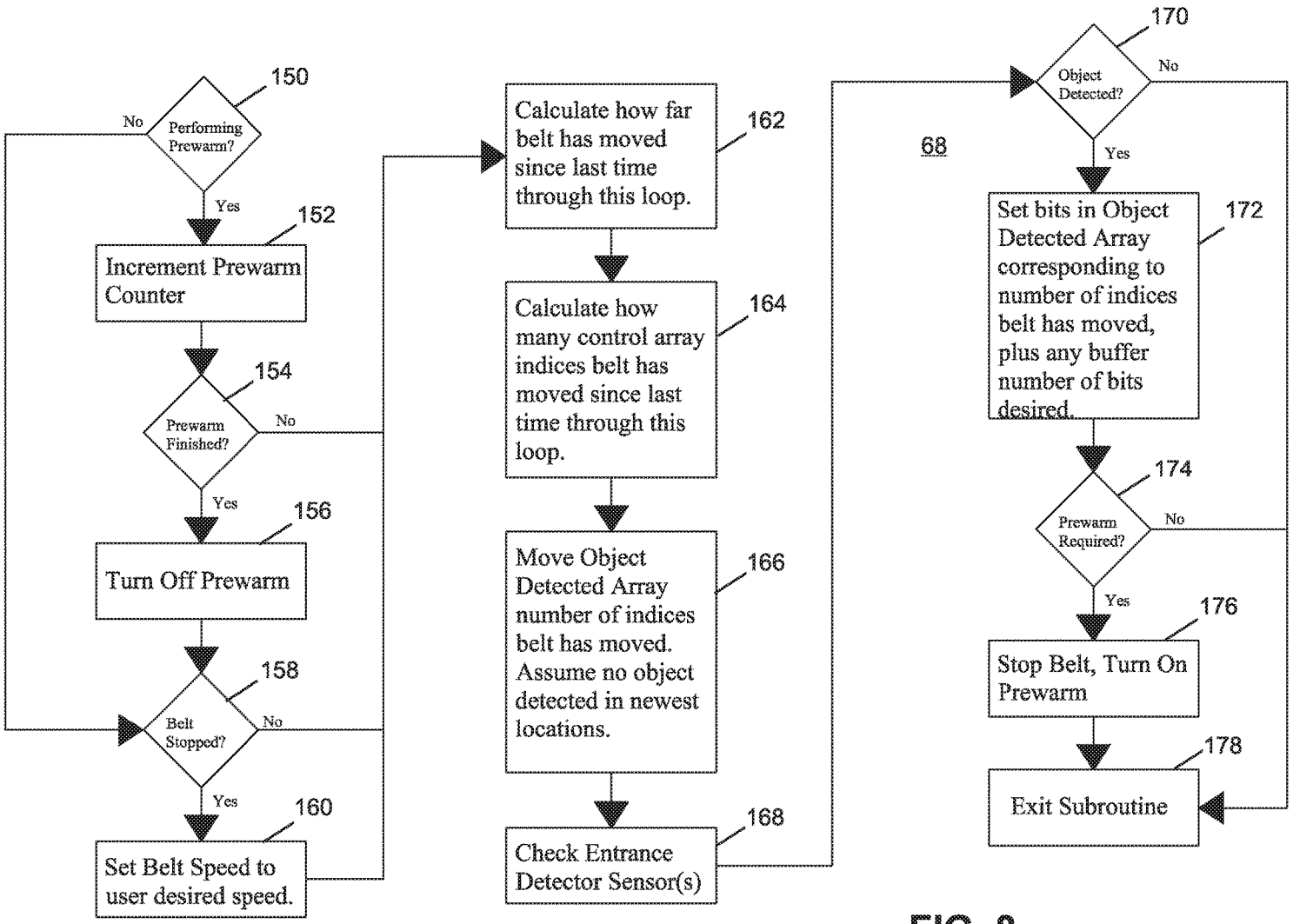
FIG. 8 is a flowchart of a conveying surface control process.
Figure 9:
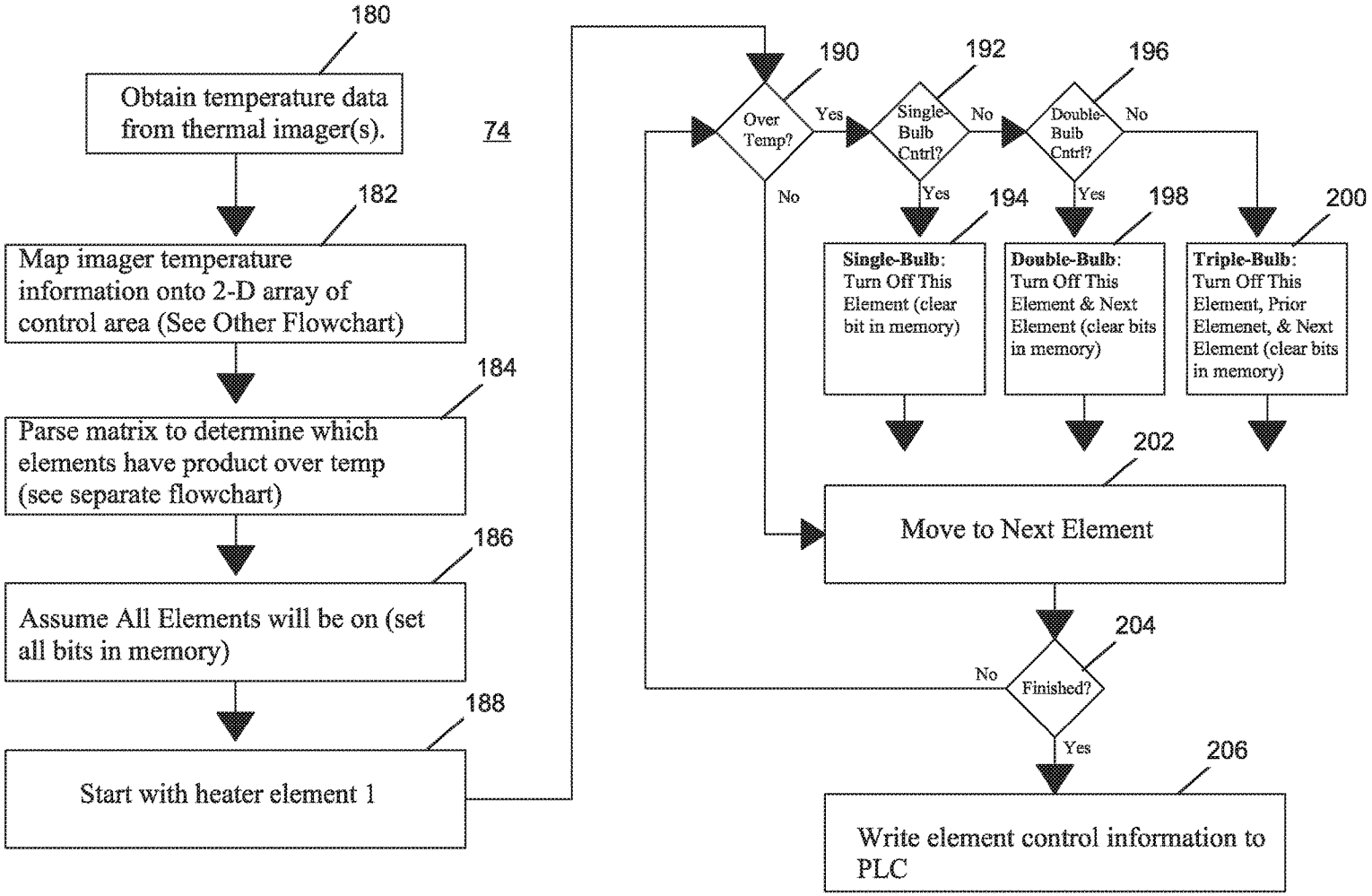
FIG. 9 is a flowchart of a temperature control process.

A control process 50 is initiated at 52 by initializing communication with thermal imagers 12 of the various zones and with controller 31 and by loading geometric values related to heating elements 14, and the like, at 54 (FIG. 4). An artifact masking array provided by a map imager process 56, illustrated in FIG. 5, is loaded to the program at 58. A mapping array, provided by a mapping array creating process 60, illustrated in FIG. 6, is carried out at 62. Process 50 enters a main control loop 64 in which changes to human machine interface 33 are observed at 66. The status of entrance detector(s) 38 is examined for the presence of an object and a belt control routine 68, illustrated in FIG. 8, are carried out at 70. A control temperature routine 72, illustrated in FIG. 9, is carried out at 74. Main control loop 64 returns to step 66 to check for changes to user input values and continues through steps 66, 70 and 74 in a loop that is operated in the illustrated embodiment at approximately three times a second, although other repetition rates may be used.

Map imager process 56 (FIG. 5) gets rid of artifacts by masking any point, or pixel, that cannot be masked by hardware. Hardware masking is preferred for removing artifacts since it reduces the amount of energy absorbed by the imaging sensors and helps keep the camera cooler. However, not all artifacts can be hardware masked so they are masked in software. The routine starts at 80 by obtaining a two-dimensional data array from thermal imaging sensor 12 at 82 and examines individual pixels beginning at 84. It is determined at 86 where the investigated pixel falls in the controlled area and uses geometric information about the layout of image sensors to determine which imager is related to that pixel. An evaluation is made at 90 whether this pixel needs to be masked in software by comparing its location with the pixel location of artifacts obtained during a calibration run without objects in the controlled area. If it is determined at 92 that the pixel does not need to be masked, the temperature data from that pixel is associated to that point in the control array. If it is determined at 92 that the pixel needs to be masked, then it is masked and the next pixel is examined at 96. When it is determined that all of the pixels for an imaging sensor have been examined at 98, the pixels for the next imaging sensor are tested at 100 until all of the pixels of all of the thermal imaging sensors have been evaluated at 102 and the routine is exited at 104.

The two-dimensional array of temperature points with appropriate pixels masked is then mapped to a two-dimensional array representing controlled area 36 with mapping array routine 60. Routine 60 begins at 106 to create the 2-D array starting with the first pixel at 108 and calculating the physical location of the point in the actual controlled area 36 corresponding to this pixel at 110. Beginning with the last heating element 14 in the control zone, it is determined at 114 whether the vertical distance of that heating element to that point in the controlled area is above an area of influence defined for that heating element. If so, then the examined location is assigned to the examined heating element at 118. If not, then the next heating element is examined at 116 to determine if the point in the image is above the area of influence for that pixel. The next position in the array is examined at 120 and the process repeats until all of the pixels have been assigned to heating elements.

Figure 7:
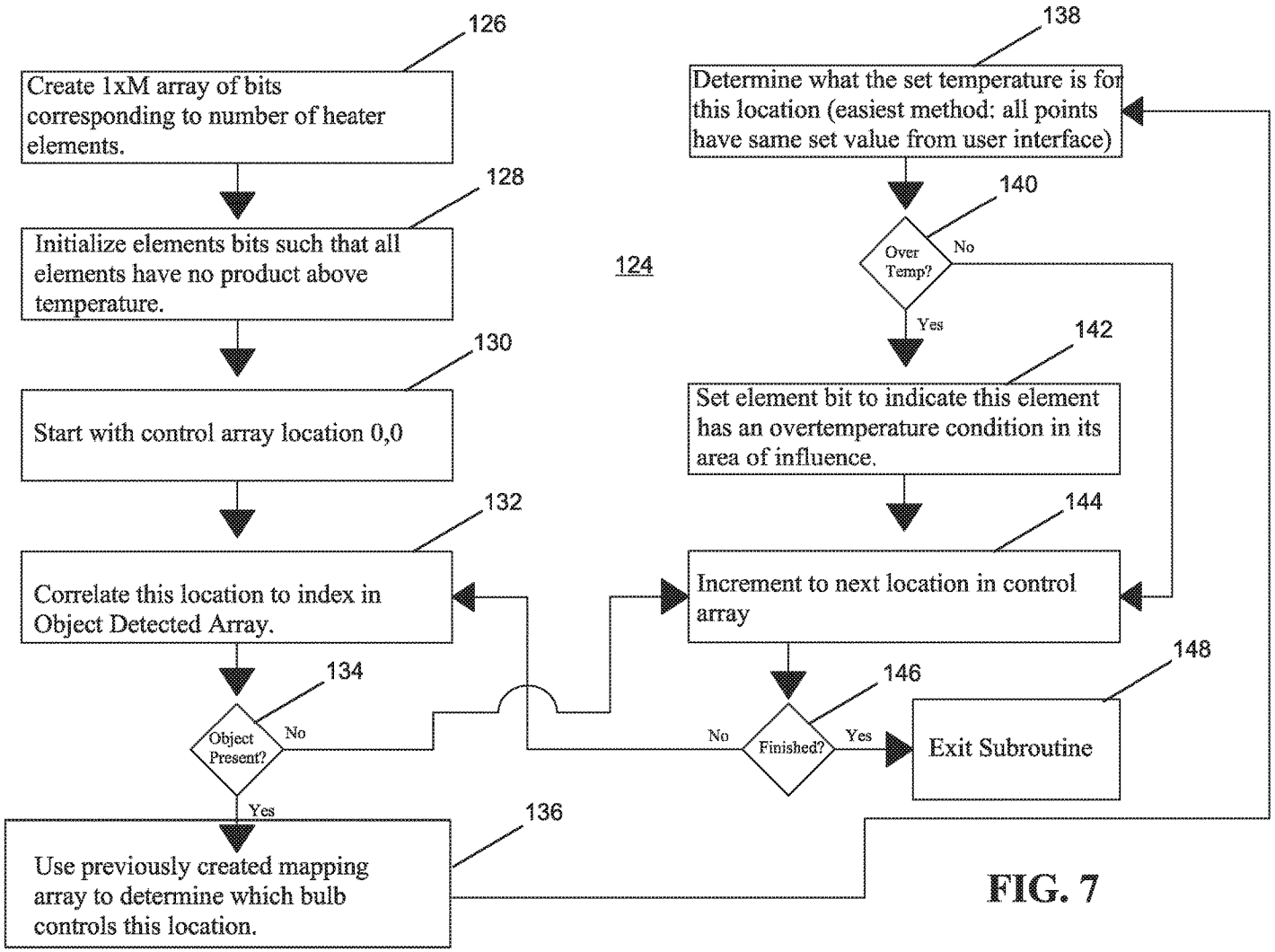
FIG. 7 is a flowchart of parsing the control array process.

Control loop 64 parses the controlled area array determined by routine 60 by a parsing routine 124 illustrated in FIG. 7. The parsing routine determines, for example, whether any object in each heating elements area of influence is above temperature. Parsing routing 124 creates a heater array of bits corresponding with the number of heater elements in the control zone at 126. The bits in the array are initialized such that all heating elements have no objects above temperature at 128. Beginning with a first pixel in the control array at 130, a correlation is made for that pixel whether it includes an object by consulting an Object Detected Array constructed at 172 (FIG. 8). If it is determined at 134 that an object is present at that pixel, the heater array constructed at 126 is used to determine which heating element heats this location at 136. It is then determined at 138 what the temperature set point is for the location and it is determined at 140 whether the temperature for this location is greater than its set point. If so, then a bit is set at 142 to indicate that this heating element has an over-temperature condition in its area of influence. The routine then increments to the next location in the controlled area to determine whether the heating element in which that point is located has an over-temperature condition. After it is determined at 146 that all locations have been analyzed, the routine is exited at 148.

Heating elements 14 can be controlled according to at least three different paradigms. They can be controlled independently in which case each heating element is turned on or off according to the temperature of an object within its area of influence.

This setting is used to bring an object up to temperature as fast as possible. It also has the capability of creating the most overshoot in temperature. In a second paradigm, when a heating element must be turned off due to the object reaching temperature in its area of influence, the heating elements on either side of that heating element are also turned off. Thus, the adjustment heating elements are partially controlled together. This causes the least amount of temperature overshoot when objects are moving slowly through the control zone. This also brings objects up to temperature at the slowest rate. In a third paradigm, when any heating element is turned off due to a controlled object reaching temperature in its area of influence, the heating element that the object will next encounter is also turned off. Thus, two adjacent heating elements are partially controlled together. This reduces temperature overshoot when objects are being conveyed at a high speed through the control zone. All three paradigms can be used in heating apparatus 10. They can be selected manually or under control of controller 31. Triple-element control is best when objects are moving slowly on conveying surface 34. Two element control works best when objects are moving quickly. Single element control works best when temperature overshoot is not a problem.

Conveying belt (conveying surface) control routine 68 keeps track of objects entering housing 11 as detected by entrance detector 38. Routine 68 begins by determining at 150 whether the heating elements are in a pre-warm mode at 150. Pre-warming the system before allowing objects to enter causes a faster and more uniform heating time. The routine counts how many seconds the heating elements have been off. When an object is detected after the heating elements have cooled down for a preset amount of time, the belt can be turned off when the system performs a pre-warm cycle. If it is determined at 150 that the system is in a pre-warm mode, a pre-warm counter is incremented at 152. It is determined at 154 whether the pre-warm cycle has completed. If so, the pre-warm mode is turned off at 156. If it is determined at 150 that the pre-warm cycle is not on, then it is determined if the belt has stopped at 158. If so, the belt is set to a desired speed at 160. If the belt has not stopped, the routine calculates at 162 how far the belt has moved since the last time the program went through the control loop and converts this to a number of pixels in the control array at 164. The control array is indexed for the belt movement at 166. The entrance sensor 38 is checked at 168 and it is determined at 170 whether it is detecting an object. If so, bits in an Object Detected Array are set at 172 corresponding to the number of pixels that the belt has moved. Also, a number of buffer bits may be included to account for desired spacing between objects. It is determined at 174 whether the object requires pre-warm. If so, the conveying surface is stopped at 176 and a pre-warm heating element is turned on. The routing is exited at 178. If no object is detected at 170 or no pre-warm is required at 174, the routine is exited at 178.

Temperature control routine 74 begins at 180 by obtaining data from thermal imaging sensor(s) 12 and mapping imager temperature data onto the two-dimensional array of the controlled area 36 at 182. The array was is determined by mapping array routine 60. The controlled area array matrix is parsed at 184 using parsing routine 124 (FIG. 7). It is assumed at 186 that all heating elements are on, and it is determined at 188 whether the first heating element is over-temperature. If not, the control moves to the next heating element at 202. If it is determined at 190 that the heating element is over-temperature, it is determined at 192 whether the control is in a single-element control paradigm. If so, the single element is turned off at 194, the bit in memory is cleared and the control moves to the next heating element at 202. If the control is not in the single-element paradigm, it is determined whether it is in the double-element control paradigm at 196. If so, the heating element and the adjacent downstream heating element are turned off and the bits in memory cleared. If the control is not in the single or double element control paradigm, it must be in the triple element paradigm and the element along with its two adjacent elements are turned off at 200 and their bits cleared in memory. When all of the heating elements are processed in this manner (204), the control writes the control information to the PLC 31 at 206. PLC 31 then turns each heating element off or on according to instructions from the control software. In the illustrated embodiment, the main control loop 64 is repeated approximately 3 times per second.

Number printing on synthetic fabrics, such as polyester and nylon, is used for manufacturing team jerseys, and the like. Such synthetic fabric is dyed during manufacture by raising the temperature to a specific temperature, known as the dye migration temperature that opens pores in the fabric, allowing the dye to enter the opened pores. When the temperature is lowered, the pores close and the dye is retained in the fabric. A difficulty with applying light-colored numbers to a colored synthetic fabric using known techniques is that the curing of the ink requires that the fabric be heated, using a prior art slope shown in FIG. 17, to a dye cure temperature level 212 that is at or above the dye migration temperature level 214 of the fabric. This causes the pores in the fabric to open and the fabric die to migrate to the ink causing the ink to take on an undesired coloration.

Figure 17:
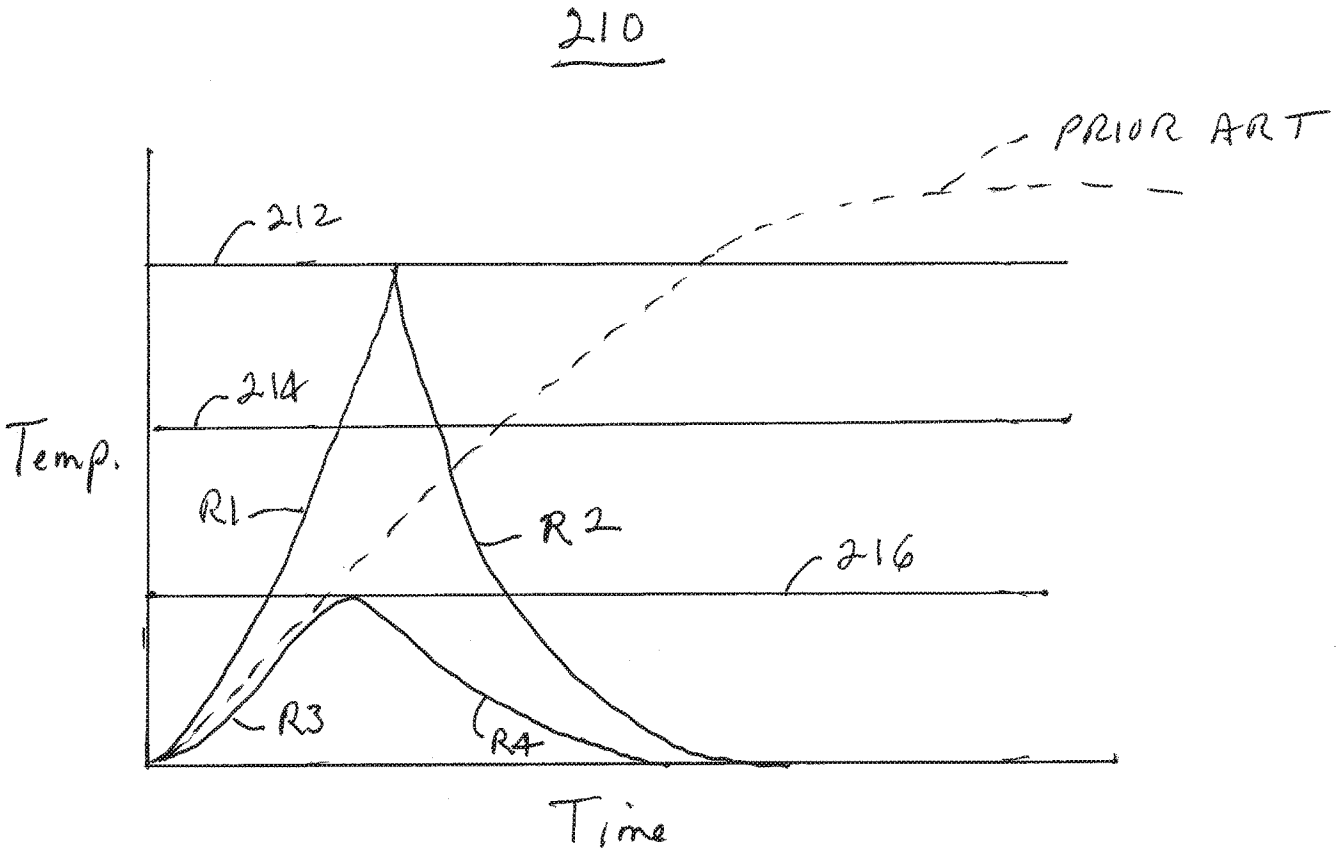
FIG. 17 is a temperature versus time diagram illustrating a method, according to an embodiment of the invention.

A method 210 of curing ink applied to the surface of a dyed fabric is illustrated in FIG. 17. The ink has an ink cure temperature 212 and the dyed fabric has a dye migration temperature 214. As can be seen in FIG. 17, the cure temperature of the ink 212 is equal to or greater than the dye migration temperature 214 of the fabric. Radiant heat is applied with heating element(s) 14 while thermal radiation of the fabric surface to which the ink is applied is monitored with thermal imaging sensor 12. Control system 18 is programmed to apply heat at a relatively high rate, shown at R1 to quickly raise the surface to ink cure temperature 212. Once this level is reached, the heating element(s) 14 are turned off, thus allowing the temperature of the fabric surface to drop off at a rate R2. Since the fabric itself absorbs infrared energy more slowly than the ink, the temperature of the fabric rises at a rate R3 to a fabric temperature 216 and decreases at a rate R4. The temperature of the fabric 216 does not reach its dye migration temperature 214 so dye migration from the fabric to the ink is significantly reduced over prior art techniques. Method 210 is most useful with synthetic fabrics, such as polyester and nylon. Thus, sublimation of the fabric dye is greatly reduced by capturing thermal image data with thermal-imaging sensor 12 directed at the fabric surface and controlling the applying of radiant heat by heating element(s) 14 as a function of the thermal radiation detected by the imaging sensor.

Thus, the invention as illustrated in the various embodiments uses feedback control on inks to allow high intensity energy to be directed at the object precisely as long as necessary to cure the ink. The surface temperature of the object, not air temperature, is the controlled variable. The energy density can then be applied at a higher rate during the initial cure and throttled back significantly to reduce or eliminate temperature overshoot. This allows the overall cure time to be reduced and the footprint of the apparatus to be reduced. This allows a greater through-put of objects cured in a smaller amount of floor space.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The embodiment of the invention in which an exclusive property or privilege is claimed are defined as follows:

1. An apparatus comprising:

at least one thermal imaging sensor that is configured to image thermal radiation of the object within a field of view;

a plurality of heating elements that are configured to generate heat energy at the object; and a control responsive to said imaging sensor for controlling said heating element, said control controlling said heating elements as a function of the thermal radiation of the object to heat the object to a particular radiation level, wherein said heating elements are within the field of view of the imaging sensor between the imaging sensor and the object and a plurality of shields between said at least one thermal imaging sensor and said heating elements, said shields shielding said heating elements from said at least one thermal imaging sensor, wherein each of said shields between said at least one thermal imaging sensor and one of said heating elements.

2. The apparatus as claimed in claim 1 wherein said plurality of shields are joined together to form a shield assembly.

3. The apparatus as claimed in claim 2 including a position adjustment for said shield assembly wherein positons of said shields can be adjusted together.

4. The apparatus as claimed in claim 1 wherein said heating elements comprise quartz heating elements having a color temperature in a range from about 1700K to about 1900 K.

5. The apparatus as claimed in claim 1 including a conveying surface, said conveying surface adapted to convey articles past said field of view from an upstream location toward a downstream location.

6. The apparatus as claimed in claim 1 wherein said at least one thermal imaging sensor comprises at least one pixilated camera having rows and columns of pixels of infrared sensors.

7. The apparatus as claimed in claim 1 including a first cooling system for removing heat energy from said at least one thermal imaging sensor and said plurality of shields and a second air flowing system that is adapted to flowing air past the object being heated wherein said first and second systems are substantially separate from each other.

8. The apparatus as claimed in claim 7 wherein said second air flowing system has variable air flow.

9. The apparatus as claimed in claim 7 wherein said second air flowing system has a recirculating flow pattern.

10. An apparatus comprising:

at least one thermal imaging sensor that is configured to image thermal radiation of the object;

a plurality of heating elements that are configured to generate heat energy at the object; and a control responsive to said imaging sensor for controlling said plurality of heating elements, said control controlling said plurality of heating elements as a function of the thermal radiation from a portion of the object detected by the imaging sensor while that portion of the object is being heated and said control controlling said plurality of heating elements to heat the surface of that portion of the object to a particular radiation level, wherein said plurality of heating elements are between the imaging sensor and the object and including at least one shield between said at least one thermal imaging sensor and said plurality of heating elements, said shield shielding said plurality of heating elements from said at least one thermal imaging sensor, wherein said control controls said heating elements as a function of surface radiation of the object adjacent each particular heating element or adjacent heating elements wherein said control is adapted to combine a selected number of adjacent heating elements to at least partially control together wherein the control selects a number of adjacent heating elements to at least partially control together as a function of a rate and particular level of radiation level selected for the object to be heated.

11. The apparatus as claimed in claim 10 wherein the number of adjacent heating elements to be partially controlled together is selected from one, two or three adjacent heating elements.

12. An apparatus comprising:

at least one thermal imaging sensor that is configured to image thermal radiation of the object;

a plurality of heating elements that are configured to generate heat energy at the object;

a control responsive to said imaging sensor for controlling said heating elements, said control controlling said heating elements as a function of the thermal radiation of the object to heat the object to a particular radiation level wherein said heating elements are between the imaging sensor and the object and at least one shield between said at least one thermal imaging sensor and said heating elements, said at least one shield shielding said heating elements from said at least one thermal imaging sensor; and a conveying surface, said conveying surface adapted to convey articles past a controlled area controlled by said control from an upstream location toward a downstream location, said control area comprising said plurality of heating elements wherein said heating elements at said upstream location have a higher wattage than heating elements at said downstream location.

13. The apparatus as claimed in claim 12 including an entrance sensor sensing an object on said conveying surface entering said controlled area.

14. The apparatus as claimed in claim 13 wherein said entrance sensor comprises a photo sensor comprising a light beam directed across an entrance to said controller area.

15. The apparatus as claimed in claim 13 wherein said control energizes said heating elements only when an object is present.

16. An apparatus, comprising:

at least one thermal imaging sensor that is configured to image thermal radiation of the object within a field of view;

at least one heating element that is configured to generate heat energy at the object, the at least one heating element within the field of view of the thermal imaging sensor; and a control responsive to said imaging sensor for controlling said heating element, said control controlling said heating element as a function of the thermal radiation of the object to heat the object to a particular radiation level wherein said at least one thermal imaging sensor comprises at least one pixilated camera having rows and columns of pixels of infrared sensors wherein said control masks artifact pixels that detect radiation from permanent features of a controlled area.

17. The apparatus as claimed in claim 16 wherein said thermal imaging sensor captures thermal images within a controlled area and including reflective surfaces around said controlled area to reflect thermal energy at edges of said controlled area back to said controlled area.

18. A method comprising:

applying radiant heat to heat ink and dyed fabric wherein the ink is applied to the dyed fabric while monitoring thermal radiation of the ink applied to the dyed fabric, said ink having an ink cure temperature, said dyed fabric having a dye migration temperature;

said applying radiant heat comprises applying radiant heat at a rate sufficient to raise temperature of the ink at a rate faster than the temperature of the fabric; and reducing the applied radiant heat when the temperature of the ink reaches the ink cure temperature and before the temperature of the fabric reaches the dye migration temperature in order to reduce bleeding of fabric dye to the ink.

19. The method as claimed in claim 18 wherein said ink cure temperature is greater than or equal to said dye migration temperature.

20. The method as claimed in claim 18 wherein said fabric comprises at least one chosen from a polyester and a nylon.

21. The method as claimed in claim 18 including capturing thermal image data with at least one thermal-imaging sensor directed at a fabric surface and controlling the applying of radiant heat as a function of the thermal radiation detected by the imaging sensor.

22. The method as claimed in claim 21 wherein said at least one thermal imaging sensor, comprises at least one pixelated camera, having rows and columns of pixels of infrared sensor.

23. A method comprising:

applying radiant heat with a plurality of heating elements that are configured to generate heat energy at the object;

monitoring thermal radiation of the object with at least one thermal imaging sensor that is configured to image thermal radiation of the object within a field of view;

controlling said heating elements in response to said at least one thermal imaging sensor as a function of the thermal radiation of the object to heat the object to a particular radiation level, wherein said heating elements are within the field of view of the imaging sensor between the imaging sensor and the object; and shielding said heating elements from said at least one thermal imaging sensor with a plurality of shields between said at least one thermal imaging sensor and said heating elements.

24. The method as claimed in claim 23 wherein said plurality of shields are joined together to form a shield assembly.

25. The method as claimed in claim 23 including a position adjustment for said shield assembly wherein positions of said shields can be adjusted together.

26. The method as claimed in claim 23 wherein said at least one thermal imaging sensor, comprises at least one pixelated camera, having rows and columns of pixels of infrared sensor.

27. The method as claimed in claim 23 used to cure ink on the object.

28. The method as claimed in claim 27 wherein the object is made of a textile.

29. The method as claimed in claim 23 used with at least one chosen from screen printing, digital printing, sublimation ink printing, discharge ink printing, and pad printing.

* * * * *